US007066165B2

(12) United States Patent
Perry

(10) Patent No.: US 7,066,165 B2
(45) Date of Patent: Jun. 27, 2006

(54) CENTER-FIRE BOW

(76) Inventor: Kent M. Perry, 275 N. 300 West, Koosharem, UT (US) 84744

( * ) Notice: Subject to any disclaimer, the term of this patent is extended or adjusted under 35 U.S.C. 154(b) by 0 days.

(21) Appl. No.: 10/922,213

(22) Filed: Aug. 18, 2004

(65) Prior Publication Data

US 2005/0039735 A1 Feb. 24, 2005

Related U.S. Application Data

(60) Provisional application No. 60/496,836, filed on Aug. 21, 2003.

(51) Int. Cl.
*F41B 5/00* (2006.01)

(52) U.S. Cl. ..... 124/23.1; 124/25.6; 124/88

(58) Field of Classification Search ..... 124/23.1, 124/24.1, 25.6, 86, 88
See application file for complete search history.

(56) References Cited

U.S. PATENT DOCUMENTS 1,526,176 A * 2/1925 O'Connell ..... 124/24.1
1,689,141 A * 10/1928 Keller ..... 124/22
1,847,593 A * 3/1932 Cameron ..... 124/24.1
2,186,386 A * 1/1940 Lowell ..... 124/24.1
2,714,377 A 8/1955 Mulkey
2,909,167 A * 10/1959 Fredrickson ..... 124/25.7
2,995,130 A 8/1961 Hoyt, Jr.
3,491,739 A * 1/1970 Scrobell ..... 124/23.1
3,599,621 A * 8/1971 Scrobell ..... 124/23.1
4,282,850 A * 8/1981 Warnicke ..... 124/24.1
4,343,286 A 8/1982 Thacker
4,457,287 A 7/1984 Babington
4,759,337 A * 7/1988 Suski ..... 124/24.1
4,787,361 A * 11/1988 Vyprachticky ..... 124/88
4,836,177 A 6/1989 Williams
5,002,035 A 3/1991 Brooks
5,009,216 A 4/1991 Ross
5,201,304 A 4/1993 Rezmer
5,243,958 A 9/1993 Shepleym, Jr.
5,349,937 A * 9/1994 Burling ..... 124/25.6
5,368,006 A * 11/1994 McPherson ..... 124/25.6
5,469,834 A 11/1995 Higgins et al.
5,649,519 A * 7/1997 Linderman ..... 124/23.1
5,694,914 A 12/1997 Henschel
5,853,000 A 12/1998 Torgerson et al.
6,142,133 A 11/2000 Anderson

* cited by examiner

*Primary Examiner*—John A. Ricci
(74) *Attorney, Agent, or Firm*—Thorpe North & Western LLP

(57) ABSTRACT

A bow includes a bow frame with a geometric center, and a window surrounding the geometric center. A bow handle is attached to the bow frame at a position offset from the geometric center, such that a user can fire an arrow through the window, through the geometric center of the bow. A gimbal may be disposed within the window, the bow handle being pivotally attached to the gimbal, so as to allow free pivoting of the bow about two substantially orthogonal axes.

18 Claims, 4 Drawing Sheets

CENTER-FIRE BOW

PRIORITY CLAIM

The present application claims priority from U.S. provisional patent application Ser. No. 60/496,836, filed Aug. 21, 2003.

BACKGROUND OF THE INVENTION

1. Field of the Invention

The present invention relates generally to archery equipment. More particularly, the present invention relates to a bow that allows an archer to fire an arrow through the geometric center of the bow.

2. Related Art

The bow is one of the most ancient weapons, and there have been innumerable designs for bows over the centuries. While the development of firearms long ago displaced bows as among the most powerful and accurate weapons, there is still widespread use of bows in sport hunting and target shooting. Because of this continued enthusiasm, there have been a number of significant improvements and changes in bows in relatively recent times. For example, the development of the compound bow and the introduction of lightweight resilient carbon fiber composite materials have greatly improved the ease of use and performance of modern bows.

Despite modern improvements, however, some traditional problems still remain. For example, the traditional straight bow of necessity fires the arrow to the side of the bow, causing a slight waver or curve in the trajectory of the arrow. To eliminate this problem, many modern bows include a lateral offset in the bow just above the handle, allowing the arrow to be fired in line with the vertical axis of the bow.

However, this solution to one problem actually introduces another problem. In order to allow the archer to steady the bow, the handle must be located at the geometric center of the bow. Because the handle occupies the center of the bow, the arrow is therefore necessarily fired slightly above center, and the arrow nock must therefore contact the bowstring slightly above center. This offset causes the bowstring to apply differential forces to the arrow, causing a vertical waver in the trajectory of the arrow.

SUMMARY OF THE INVENTION

It has been recognized that it would be advantageous to develop a bow that avoids the vertical and horizontal offsets that affect the trajectory of an arrow.

The invention provides a bow, including a bow frame with a geometric center, and a window surrounding the geometric center. A bow handle is attached to the bow frame at a position offset from the geometric center, such that a user can fire an arrow through the window, through the geometric center of the bow.

In accordance with a more detailed aspect of the present invention, a gimbal is disposed within the window, and the bow handle is pivotally attached to the gimbal, allowing free pivoting of the bow about two substantially orthogonal axes.

In accordance with another more detailed aspect of the present invention, the bow further includes a stabilizer bar, rearwardly extending from the bow handle, configured to contact an arm of a user of the bow, to compensate for moment generated by the offset between the geometric center and the position of the handle.

Additional features and advantages of the invention will be apparent from the detailed description which follows, taken in conjunction with the accompanying drawings, which together illustrate, by way of example, features of the invention.

DETAILED DESCRIPTION

Figure 1:
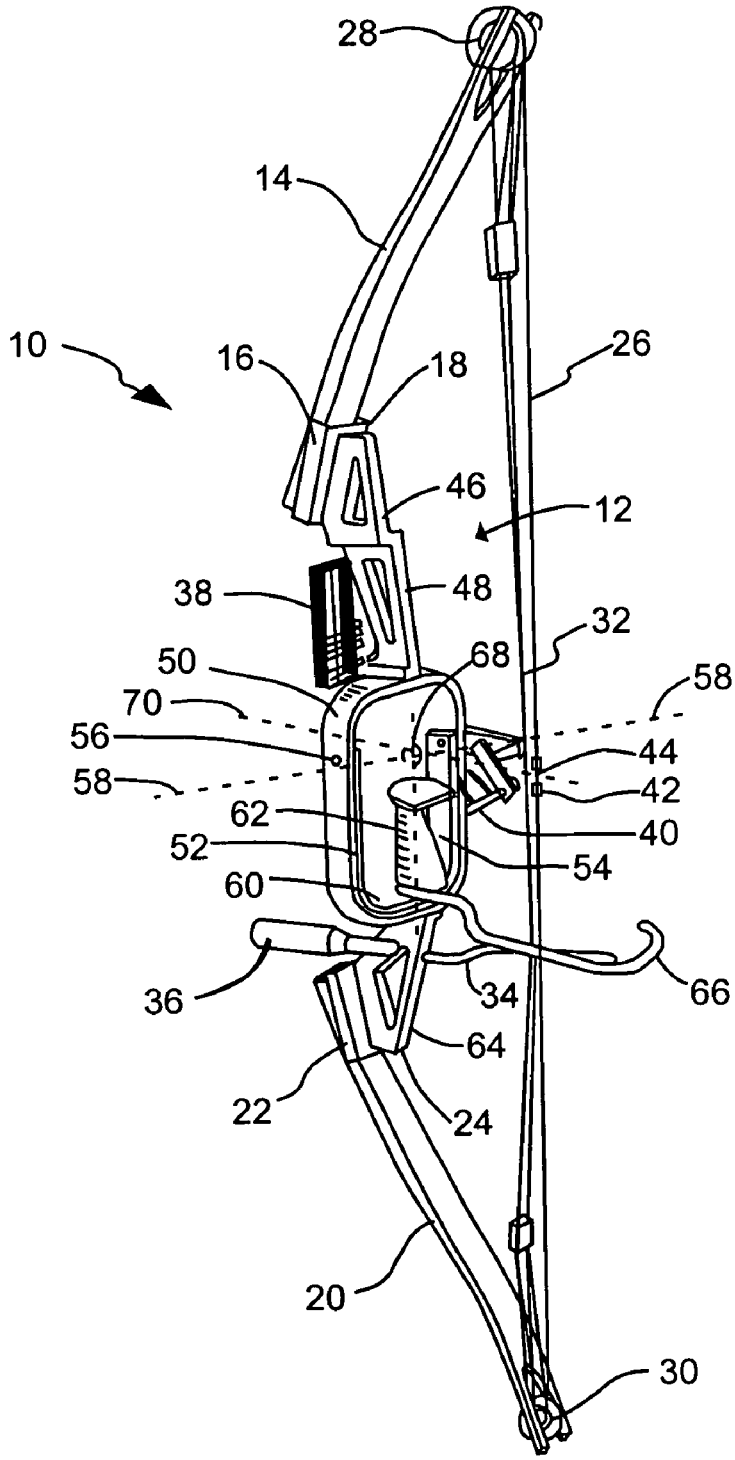
FIG. 1 is a perspective view of one embodiment of a bow in accordance with the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

The bow of the present invention is designed so that the arrow can be fired through the geometric center of the bow, the place that is normally occupied by the archer's hand, rather than above or to the side of the center. This configuration allows greater accuracy. This is accomplished by providing a riser that includes a center window through which the arrow is fired. This allows the shooter to effectively hold the bow from both sides of center using a gimbal-mounted handle.

Figure 2:
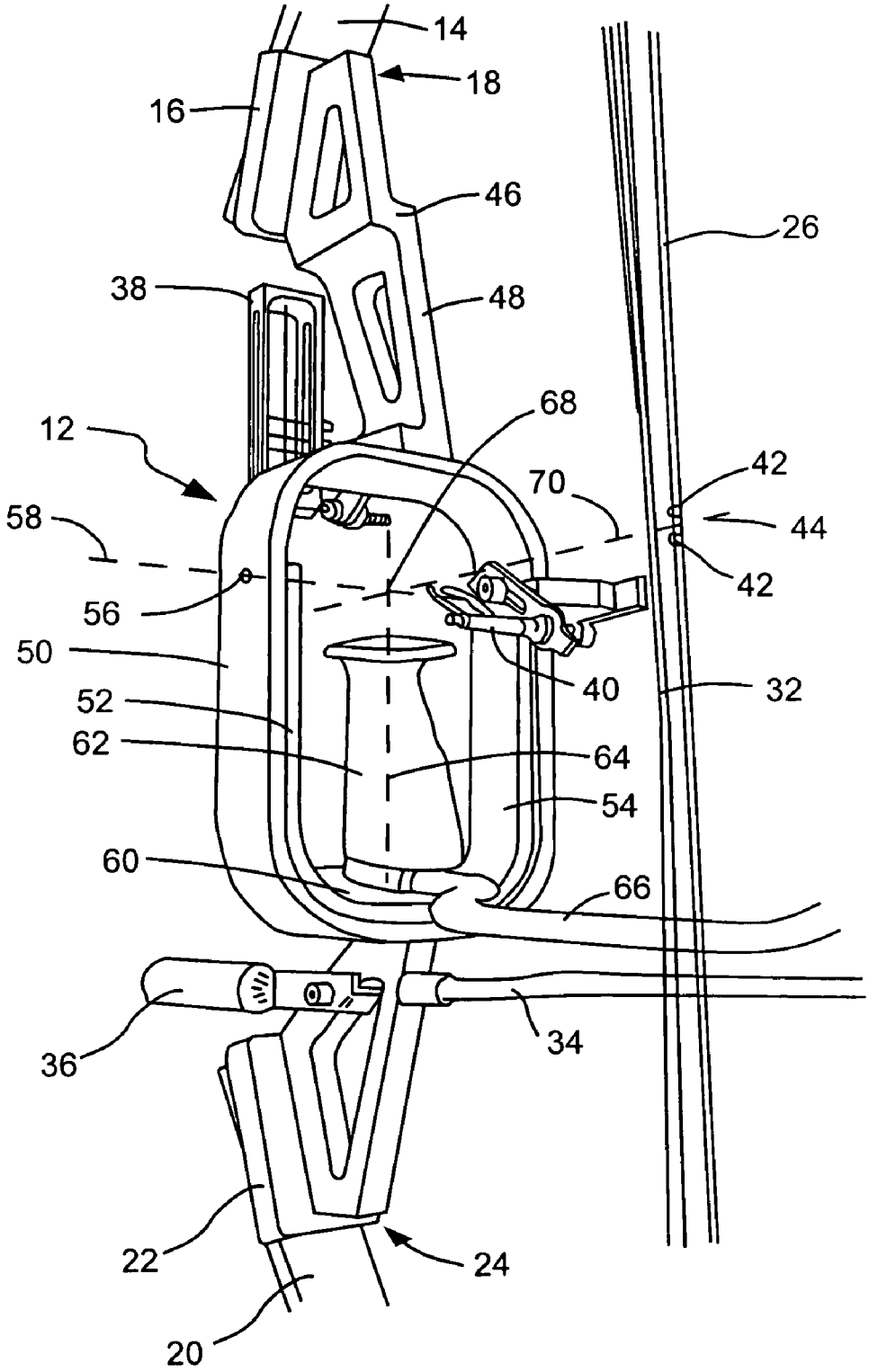
FIG. 2 is a close-up perspective view of the riser of the bow of FIG. 1.

With reference to FIGS. 1 and 2, one embodiment of a bow 10 in accordance with the present invention comprises a riser 12, an upper bow limb 14 attached to an upper base mount 16 at the upper end 18 of the riser, a lower bow limb 20 attached to a lower base mount 22 at the lower end 24 of the riser, and a bowstring 26 connected between the extremities of the limbs. The riser and limbs together can be considered to comprise the bow frame. The bow depicted is a compound bow, having a top cam assembly 28, a bottom cam assembly 30, a tension line 32 connected therebetween, and a cable guard bar 34 extending rearwardly from the riser for deflecting the tension line out of the line of the bowstring.

The bow includes other features typical of bows, including a counterweight 36 extending from the front of the riser, an adjustable bow sight 38 for aiming the bow, and an adjustable arrow rest 40. The bow string also includes a pair of nock point indicator bushings 42 for indicating the nock point 44, which represents the proper point for aligning an arrow nock with the bow string. It will be apparent to those skilled in the art that the bow also includes other features not specifically mentioned, and can include other features not shown that are well known in the art.

Figure 3:
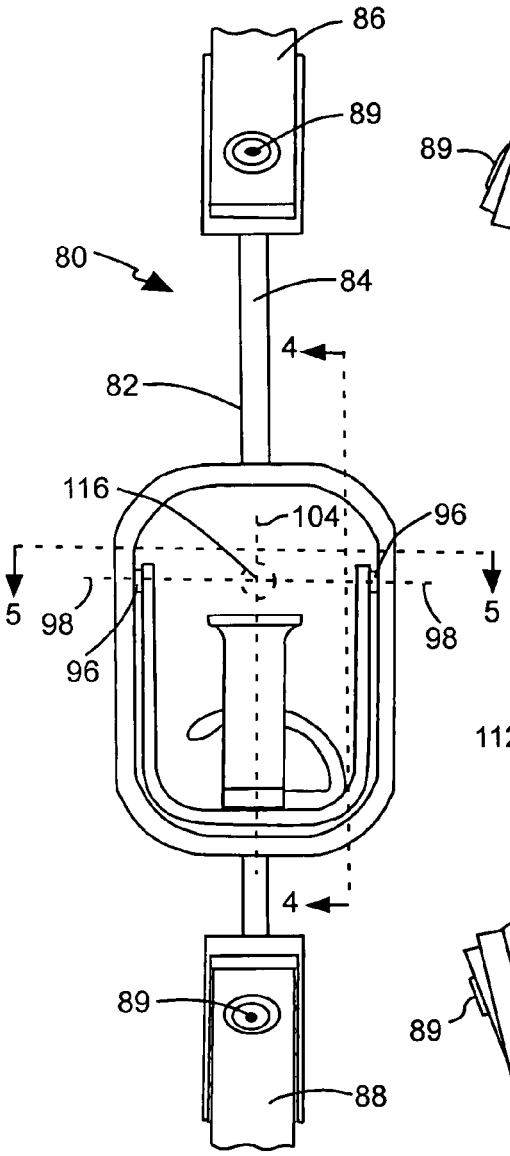
FIG. 3 is a partial front view of an alternative embodiment of a center-fire bow in accordance with the present invention.
Figure 4:
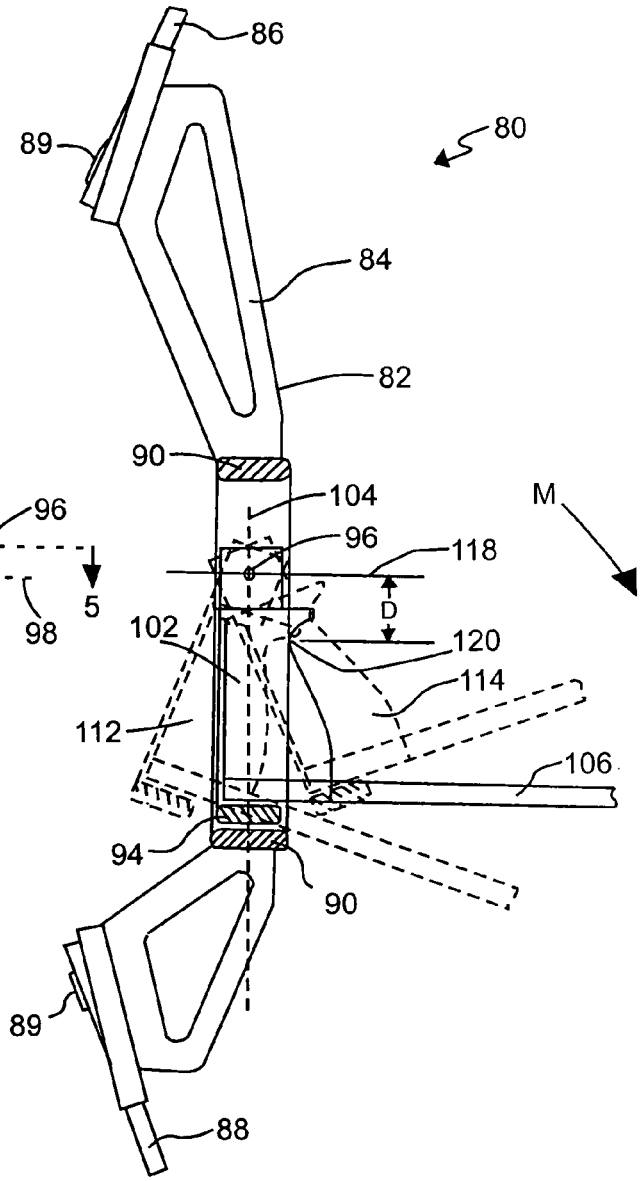
FIG. 4 is a side, partially cross-sectional view of the bow of FIG. 3.
Figure 5:
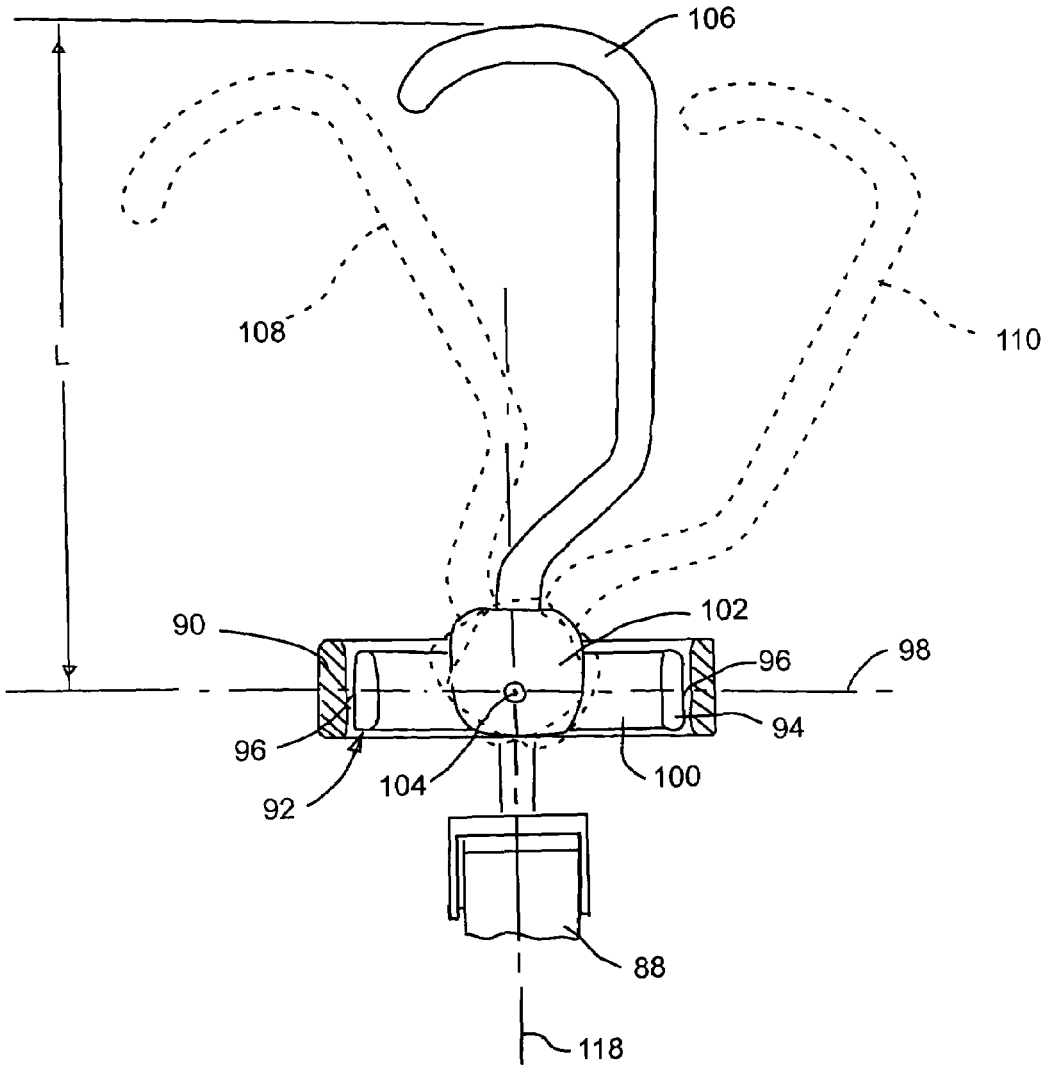
FIG. 5 is a top, partially cross-sectional view of the bow of FIG. 3.

While the embodiment depicted in FIGS. 1 and 2 is a compound bow, it will be apparent that the present invention is not limited to compound bows, or limited to compound bows of the configuration shown. Likewise, the present invention is not limited to bows having the exact structural geometry shown in FIGS. 1 and 2. For example, the riser 12 of the bow of FIGS. 1 and 2 includes an upper frame 46 having an offset portion 48 to allow a clear view of the bow sight 38. An alternative bow 80, shown in FIGS. 3–5, includes a riser 82 with a straight upper frame 84. Many other configurations are also possible. Additionally, the embodiment of FIGS. 3–5 is shown without a bow sight, arrow rest, or counterweight, though it will be apparent that these features may be added.

In the embodiment of FIGS. 1 and 2, the base mounts 16 and 22 each include a double-tapered groove (not visible) for affixing the limbs 14 and 20 thereinto using wedges, so that the limbs are held solidly at a desired angle. This configuration allows one to attach any type of limb, such as compound, recurve, etc., to the riser 12 with very little effort or time. Alternatively, as shown in the embodiment of FIGS. 3–5, the limbs 86, 88 may be bolted to the base mounts with bolts 89, as is common in many bows. While bolted connections can be used, the inventor believes that limbs attached with the double-tapered groove system are more secure and more resistant to slight movement or loosening with use.

While the bow of FIGS. 1 and 2 differs in some respects from that shown in FIGS. 3–5, both embodiments depicted include the center-fire features described below. To provide the center-fire capability, the riser 12, 82 advantageously includes a firing window or frame 50, 90, with a gimbal 52, 92 disposed therein. The gimbal includes a U-shaped member 54, 94 that is pivotally attached to the window at lateral pivot points 56, 96, and configured to pivot about a horizontal axis 58, 98. Pivotally attached to the bottom portion 60, 100 of the U-shaped member is a handle 62, 102 that is configured to pivot about a vertical axis 64, 104. A stabilizer bar 66, 106 extends rearwardly from the handle. It will be apparent that the designation of horizontal and vertical axes is arbitrary, and is primarily intended to provide a common frame of reference for describing the bow. These designations do not necessarily relate to the earth's horizon, given that a bow can be held and fired in a variety of positions.

The window 50, 90 is a part of the riser. The window can be integrally formed as part of the riser, or the riser can be assembled from multiple pieces. Nevertheless, those skilled in the art will recognize that the window must have sufficient structural strength to bear the large bending forces experienced by the bow. Ordinarily, the structure at the geometric center of a bow (typically at the location of the handle) is the thickest and most robust portion of the bow structure, because the bending forces are largest at that point. However, with the bow of the present invention, there is no structure at the geometric center. There is only empty space. Consequently, the bending stresses that ordinarily pass through the geometric center of the bow structure are borne on either side of the geometric center, by the frame of the window, which creates a ring around the bow center. It will be apparent that this configuration requires that the structure of the window (and also of the gimbal 52, 92) be sufficient to withstand these forces.

Shown in dashed lines in the top view of FIG. 5 is a left pivoted position 108 and a right pivoted position 110 of the handle 102 and stabilizer bar 106 relative to the U-shaped member and window 90. Shown in dashed lines in the side view of FIG. 4 is a forward pivoted position 112 and a rearward pivoted position 114 of the U-shaped member 94 and handle 102. These views are not intended to show the full range of motion of the handle and the U-shaped member, but are intended to be representative of how these members pivot with respect to the bow structure in general and the window in particular.

With this bow configuration, the firing point 68, 116 coincides with the geometric center of the bow 10, 80, inside the firing window 50, 90, above the handle 62, 102. The firing point/bow center coincides with the intersection of the horizontal axis 58, 98 and the vertical axis 64, 104. With reference to FIG. 2, the arrow rest 40 is disposed directly behind the bow center 68, between the handle 62 and the nock point 44 on the bowstring 26. A horizontal line between the firing point and the nock point represents the firing axis (70 in FIGS. 1–2, 118 in FIGS. 3–5) of the bow. The firing axis is preferably horizontal (with respect to the bow) and perpendicular to both the horizontal axis and vertical axis, passing through the center point of the bow. The arrow rest is preferably oriented to support an arrow in alignment with the firing axis when the bow is drawn and an arrow is fitted on the nock point. The result is a bow that is configured to fire an arrow directly through the geometric center of the bow, rather than along a line that is offset from the center.

When firing an arrow, an archer normally draws the bow (and the rear extremity of the arrow) back to a position approximately at the level of his/her chin. A peephole (not shown) is provided in the bow string several inches above the nock point 44. With the bow drawn, the archer looks through the peephole and aligns the crosshairs of the bow sight 38 with the target to fire. To compensate for the arc of the arrow with distance, the height of the peephole above the nock point is greater than the height of the bow sight above the geometric center 68, so that the line of sight from the peephole to the crosshairs of the bow sight is slightly downward relative to the firing axis 70. The bow sight includes several horizontal pins, each one at a different height above the geometric center, the lower pins corresponding to greater target distances (by producing a line of sight that is more downward relative to the firing axis), and the higher pins corresponding to closer target distances (by producing a line of sight that is closer to parallel with the firing axis).

While most archers use a bow sight as described above, a few archers prefer to sight along the arrow itself. The present invention makes doing so easier because the line of the arrow (i.e., the firing axis 70) passes through the window 50, 90. The window thus allows a concurrent unobstructed full view through the window of a center target region aligned with the arrow trajectory at the same time as release of the arrow through the geometric center 68.

As most clearly shown in FIG. 4, the main pressure point 120 of the handle 102 is located a distance D below the center point 116 and the firing axis 118. Because of this offset, a clockwise vertical moment M (shown in the side view of FIG. 4) will be created when the bow is drawn. To counter this moment, the stabilizer bar 106 extends rearwardly a distance L (shown in FIG. 5) from the base of the handle, and is configured to extend over an archer's forearm. The stabilizer bar counters the vertical moment M created by the vertically offset handle by placing a downward force on the archer's forearm, allowing a user to pull the bowstring without putting pressure on the wrist. This reduces hindrance to the archer's aiming the bow. Because the stabilizer bar is relatively long, the vertical force applied to the forearm is relatively small.

With reference again to FIGS. 1–2, this bow configuration allows an archer to effectively hold the center point 68 of the bow 10, while firing an arrow right through the center point. It also allows the nock point 44 to be located at the exact center of the bowstring 26, so that energy from the top cam assembly 28 and bottom cam assembly 30 can release at the same time and with the same force. This helps eliminate any waver or sway in the arrow's flight because of unequal forces from the bow string. Other bows nock the arrow a little above the center of the bowstring, and regardless of the adjustments made, there is always some sway that is put on the arrow.

The gimbal configuration also allows follow-through to be truer, regardless of how the archer holds the wrist. Upon release of an arrow, an archer's wrist frequently twists slightly if the archer is holding with a fist, and somewhat less if his fingers are straight. With the present invention, any twist in the wrist (horizontal or vertical) is taken up by pivoting in the gimbal 52, 92, without twisting the bow. This allows the bow 10, 80 to stay straight, regardless of twist in the archer's wrist.

A variety of materials are suitable for manufacture of the center-fire bow of the present invention. For ease of use, lightweight materials are generally preferred, such as are currently used in the manufacture of sport and hunting bows. For example, the inventor has manufactured a bow in accordance with the invention having an aluminum riser in the configuration shown. Alternatively, the riser could be manufactured of other materials, such as wood, titanium, polymers, fiberglass, carbon fiber composites, etc.

By way of example, and without limitation, the invention can be described as a bow, comprising a bow frame with a geometric center, and a window surrounding the geometric center. A bow handle is attached to the bow frame at a position offset from the geometric center, such that a user can fire an arrow through the window, through the geometric center of the bow.

As another example, the invention can be described as a bow, comprising a bow frame with a geometric center, a window surrounding the geometric center, and a gimbal pivotally disposed within the window. The bow handle is pivotally attached to the gimbal, allowing free pivoting of the bow about two substantially orthogonal axes.

As yet another example, the invention can be described as a bow, comprising a bow frame with a geometric center, and a window surrounding the geometric center. A bow handle is attached to the bow frame at a position offset from the geometric center, with a stabilizer bar, rearwardly extending from the bow handle. The stabilizer bar is configured to contact an arm of a user of the bow, to compensate for moment generated by the offset between the geometric center and the position of the handle.

It is to be understood that the above-referenced arrangements are illustrative of the application for the principles of the present invention. It will be apparent to those of ordinary skill in the art that numerous modifications can be made without departing from the principles and concepts of the invention as set forth in the claims.

What is claimed is:

1. A bow, comprising:

a. a bow frame having a geometric center;

b. a window defined by a window frame substantially completely surrounding the geometric center, such that a user of the bow can fire an arrow through the geometric center of the bow;

c. a gimbal, pivotally attached to the window frame; and d. a bow handle, pivotally attached to the gimbal at a position offset from the geometric center of the bow, the gimbal and bow handle being configured to allow free pivoting of the bow about two substantially orthogonal axes.

2. A bow in accordance with claim 1, further comprising a stabilizer bar, rearwardly extending from the bow, configured to contact an arm of a user of the bow, so as to compensate for moment generated by the offset between the geometric center and the position of the handle.

3. A bow in accordance with claim 2, wherein the stabilizer bar is connected to the bow handle.

4. A bow in accordance with claim 1, further comprising: a bow string, connected between opposing ends of the bow frame, having a center and a nock point at the center, the bow being configured such that a user can fire the arrow through the geometric center of the bow with the arrow nocked at the nock point.

5. A bow in accordance with claim 1, wherein the bow is a compound bow.

6. A bow in accordance with claim 1, wherein the bow frame further comprises: an upper limb, a lower limb, and a riser interconnecting the upper and lower limbs, the window frame comprising a portion of the riser.

7. A bow in accordance with claim 6, wherein the limbs are selectively removable from the riser.

8. A bow in accordance with claim 6, further comprising: a bow string, connected between the upper limb and the lower limb, having a center and a nock point substantially at the center, the bow being configured such that a user can fire the arrow through the geometric center of the bow with the arrow nocked at the nock point.

9. A bow in accordance with claim 8, further comprising:

an upper cam mechanism, disposed at an extreme upper end of the upper limb, and operatively connecting the bow string to the upper limb;

a lower cam mechanism, disposed at an extreme lower end of the lower limb, and operatively connecting the bow string to the lower limb; and a tension line, interconnected between the upper cam mechanism and the lower cam mechanism, the cam mechanisms and tension line being configured to reduce tension on the bow string and increase tension on the tension line when the bow string is fully drawn.

10. A bow in accordance with claim 1, wherein the window is configured to allow a concurrent full view of a center target region aligned with an arrow trajectory at the same time as release of the arrow through the geometric center.

11. A bow in accordance with claim 1, further comprising an arrow rest, attached to the window frame and extending therinto, configured to support an arrow shaft so as to place a center axis of the arrow shaft substantially at the geometric center.

12. A bow in accordance with claim 11, wherein the bow frame further comprises:

a. an upper limb;

b. a lower limb; and c. a riser, interconnecting the upper and lower limbs, the window frame comprising a central portion of the riser.

13. A bow, comprising:

a. a bow frame having a geometric center;

b. a window defined by a window frame substantially completely surrounding the geometric center, such that a user of the bow can fire an arrow through the geometric center of the bow;

c. a gimbal, pivotally attached to the bow frame; and d. a bow handle, pivotally attached to the gimbal at a position disposed below the geometric center of the bow, the gimbal and bow handle being configured to allow free pivoting of the bow about two substantially orthogonal axes.

14. A bow, comprising:

a. a bow frame, having a geometric center;

b. a bow string, connected between opposing ends of the bow frame, having a nock point substantially at a geometric center of the bow string;

c. a window frame, integrally disposed in a center of the bow frame and surrounding the geometric center;

d. a gimbal, pivotally attached to the window frame;

e. a bow handle, pivotally attached to the gimbal and offset below the geometric center, the bow handle being configured to pivot about an axis that is substantially perpendicular to a pivoting axis of the gimbal, so as to allow free pivoting of the bow about two substantially orthogonal axes, the bow being configured such that a user can fire an arrow through the geometric center of the bow with the arrow nocked at the nock point.

15. A bow in accordance with claim 14, wherein the gimbal is pivotally attached to the window frame.

16. A bow in accordance with claim 14, further comprising a stabilizer bar, rearwardly extending from the bow handle, configured to contact an arm of a user of the bow, so as to compensate for moment generated by the offset between the geometric center and the position of the handle.

17. A bow in accordance with claim 14, further comprising an arrow rest, attached to the window frame and extending thereinto, configured to support an arrow shaft so as to place a center axis of the arrow shaft substantially at the geometric center.

18. A bow, comprising:

a. a bow frame, having a longitudinal axis and a geometric center;

b. a bow string, connected between opposing ends of the bow frame, having a center and a nock point at the center, and being oriented substantially parallel to the longitudinal axis;

c. a window, integrally disposed in a center of the bow frame and surrounding the geometric center of the bow;

d. a gimbal, disposed within the window and configured to pivot about an axis that is substantially perpendicular to the longitudinal axis of the bow frame;

e. a bow handle, attached to the gimbal and offset from the geometric center, the handle being configured to pivot about an axis that is substantially parallel to the longitudinal axis of the bow, the gimbal and bow handle being configured to allow free pivoting of the bow about two axes relative to the handle, the pivotal axis of the gimbal and the pivotal axis of the bow handle intersecting substantially at the geometric center of the bow; and a stabilizer bar, extending from the bow, configured to contact an arm of a user of the bow, such that a user can fire an arrow through the geometric center of the bow with the arrow nocked at the nock point, the stabilizer bar compensating for moment generated by the offset between the geometric center and the position of the handle.

* * * * *